US010344639B1

(12) United States Patent
Nickols et al.

(10) Patent No.: US 10,344,639 B1
(45) Date of Patent: Jul. 9, 2019

(54) COOLING APPARATUSES FOR COOLING LUBRICANT IN A CRANKCASE OF A MARINE ENGINE

(71) Applicant: Brunswick Corporation, Lake Forest, IL (US)

(72) Inventors: Thomas F. Nickols, Oakfield, WI (US); Daniel P. Hoffman, Waupun, WI (US); Gregg D. Langenfeld, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 0 days.

(21) Appl. No.: 15/476,163

(22) Filed: Mar. 31, 2017

(51) Int. Cl.

| | |
|---|---|
| ***F01M 5/00*** | (2006.01) |
| ***F02F 7/00*** | (2006.01) |
| ***B63H 20/28*** | (2006.01) |
| ***B63H 21/38*** | (2006.01) |
| *F02B 61/04* | (2006.01) |

(52) U.S. Cl.
CPC ..... *F01M 5/002* (2013.01); *B63H 20/285* (2013.01); *B63H 21/386* (2013.01); *F02F 7/0043* (2013.01); *B63B 2758/00* (2013.01); *B63B 2770/00* (2013.01); *F02B 61/045* (2013.01)

(58) Field of Classification Search
CPC ..... F05D 2260/602; F01M 11/0004; F01M 2011/0054; F01M 2011/0066; F16N 31/00
USPC ..... 123/196 A, 196 R, 196 CP; 184/6.5, 184/11.1, 11.2
See application file for complete search history.

(56) References Cited

U.S. PATENT DOCUMENTS 1,536,499 A * 5/1925 Horvath ..... F01M 5/001 123/196 AB
1,789,384 A * 1/1931 Groehn ..... F16N 7/26 174/15.1
1,892,443 A * 12/1932 Winslow ..... F01M 11/03 184/6.24
5,038,890 A * 8/1991 Tanaka ..... F01M 11/0004 123/196 R
5,408,965 A * 4/1995 Fulton ..... F01M 5/002 123/196 AB
5,439,404 A * 8/1995 Sumigawa ..... B63H 21/38 123/196 R
5,467,843 A * 11/1995 Esch ..... F01M 11/00 123/192.2
6,019,071 A * 2/2000 MacIejka, Jr. ..... F01M 11/0004 123/195 H (Continued)

FOREIGN PATENT DOCUMENTS

DE 3142327 A1 * 5/1983 ..... F02F 7/00

OTHER PUBLICATIONS

Unpublished U.S. Appl. No. 15/295,358, filed Oct. 17, 2016.

*Primary Examiner* — Marguerite J McMahon
*Assistant Examiner* — Teuta B Holbrook
(74) *Attorney, Agent, or Firm* — Andrus Intellectual Property Law, LLP

(57) ABSTRACT

A marine engine has a crankcase having a crankshaft that rotates about a vertical crankshaft axis; a cover on the crankcase; and a cooling member disposed in the crankcase. The cooling member has an inner surface that faces the crankshaft and an outer surface that faces the cover. The cooling member is configured such that rotation of the crankshaft causes lubricant in the crankcase to impinge on and drain down both the inner and outer surfaces of the cooling member.

20 Claims, 8 Drawing Sheets

(56) References Cited

U.S. PATENT DOCUMENTS 6,076,495 A 6/2000 Takahashi et al.
6,217,758 B1 * 4/2001 Lee ..... F01M 11/0004 210/167.06
6,286,476 B1 * 9/2001 Hiraoka ..... F01M 11/02 123/196 R
6,550,448 B1 * 4/2003 Isogawa ..... F02B 61/045 123/336
6,742,481 B2 * 6/2004 Baldwin ..... F01M 1/08 123/41.35
7,198,019 B1 4/2007 Belter
7,341,039 B1 * 3/2008 Jaszewski ..... F01M 11/0004 123/195 AC
7,360,520 B2 * 4/2008 Tullis ..... F01M 11/0004 123/195 R
7,516,728 B1 * 4/2009 Staley ..... F01M 11/0004 123/195 C
8,302,577 B2 * 11/2012 Wunsch ..... F01M 11/0004 123/195 C
8,656,885 B2 * 2/2014 Negoro ..... F01M 11/0004 123/195 C
8,696,394 B1 * 4/2014 Langenfeld ..... F01M 11/0004 123/196 AB
9,457,881 B1 10/2016 Belter et al.
2003/0024491 A1 * 2/2003 Kinomoto ..... F01P 3/20 123/41.14
2004/0177826 A1 * 9/2004 Duwel ..... F01M 11/0004 123/196 R
2004/0177827 A1 * 9/2004 Hoyte ..... F01M 11/0004 123/196 AB
2005/0279316 A1 * 12/2005 Rice ..... F01M 11/0004 123/195 C
2007/0056548 A1 * 3/2007 Hazelton ..... F01M 11/0004 123/195 C
2008/0202724 A1 * 8/2008 Lorenz ..... F28D 7/0075 165/51
2008/0302207 A1 12/2008 Breidenbach et al.
2010/0212867 A1 * 8/2010 Hollweck ..... F01M 5/002 165/104.19
2012/0067319 A1 * 3/2012 Cygan, Jr. ..... F01M 11/0004 123/196 A
2018/0251202 A1 9/2018 Saruwatari

* cited by examiner

COOLING APPARATUSES FOR COOLING LUBRICANT IN A CRANKCASE OF A MARINE ENGINE

FIELD

The present disclosure generally relates to marine engines and more particularly to vertically-oriented marine engines, such as outboard marine engines, having a crankcase and cooling apparatuses for cooling lubricant in the crankcase.

BACKGROUND

The following U.S. Patent and U.S. Patent Application are incorporated herein by reference in entirety.

U.S. Pat. No. 9,457,881 discloses an outboard marine engine having an engine block; a crankcase on the engine block; a crankshaft disposed in the crankcase for rotation about a crankshaft axis; a cover on the crankcase; a bedplate disposed between the engine block and the cover, the bedplate having a plurality of bearings for supporting rotation of the crankshaft; and a cooling water jacket that extends parallel to the crankshaft axis along a radially outer portion of the plurality of bearings. The cooling water jacket carries cooling water for cooling the plurality of bearings and an oil drain-back area is located adjacent to the cooling water jacket. The at least one oil drain-back area drains oil from the crankcase.

U.S. patent application Ser. No. 15/295,358, filed Oct. 17, 2016, discloses an outboard marine engine comprising a crankcase; a crankshaft disposed in the crankcase and being rotatable about a crankshaft axis; a crankcase cover on the crankcase, the crankcase cover enclosing the crankshaft in the crankcase; and an air intake plenum that is integrally formed with the crankcase cover. The air intake plenum conveys intake air for combustion in the outboard marine engine.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter. In certain examples disclosed herein, a marine engine comprises a crankcase having a crankshaft that rotates about a vertical crankshaft axis; a cover on the crankcase; and a cooling member disposed in the crankcase. The cooling member comprises an inner surface that faces the crankshaft and an outer surface that faces the cover. The cooling member is configured such that rotation of the crankshaft causes lubricant in the crankcase to impinge on and drain down both the inner and outer surfaces of the cooling member.

BRIEF DESCRIPTION OF THE DRAWINGS

Examples of apparatuses for outboard marine engines are described with reference to the following drawing figures. The same numbers are used throughout to reference like features and components.

DETAILED DESCRIPTION OF THE DRAWINGS

Figure 1:
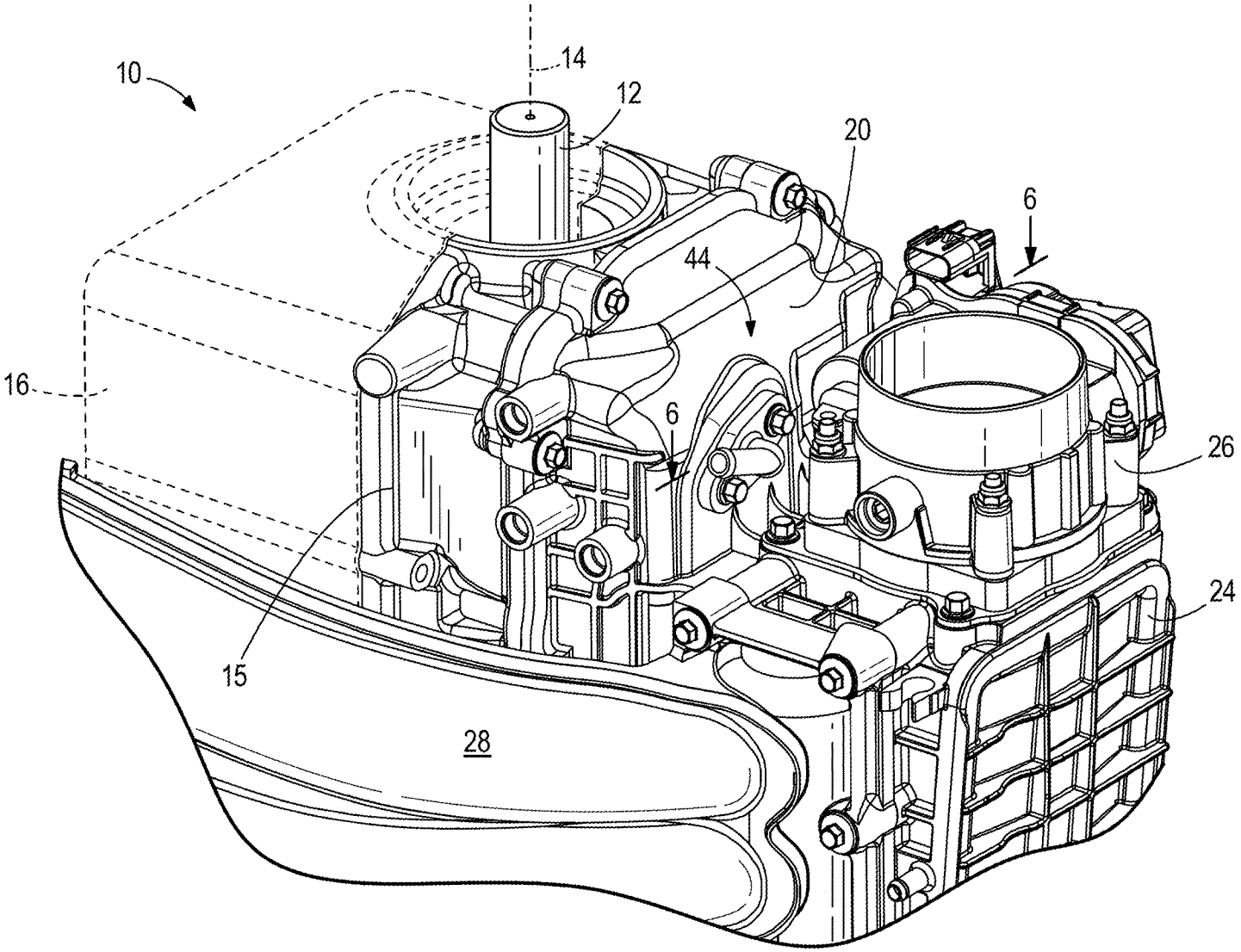
FIG. 1 is a perspective view of an upper portion of an outboard marine engine.
Figure 2:
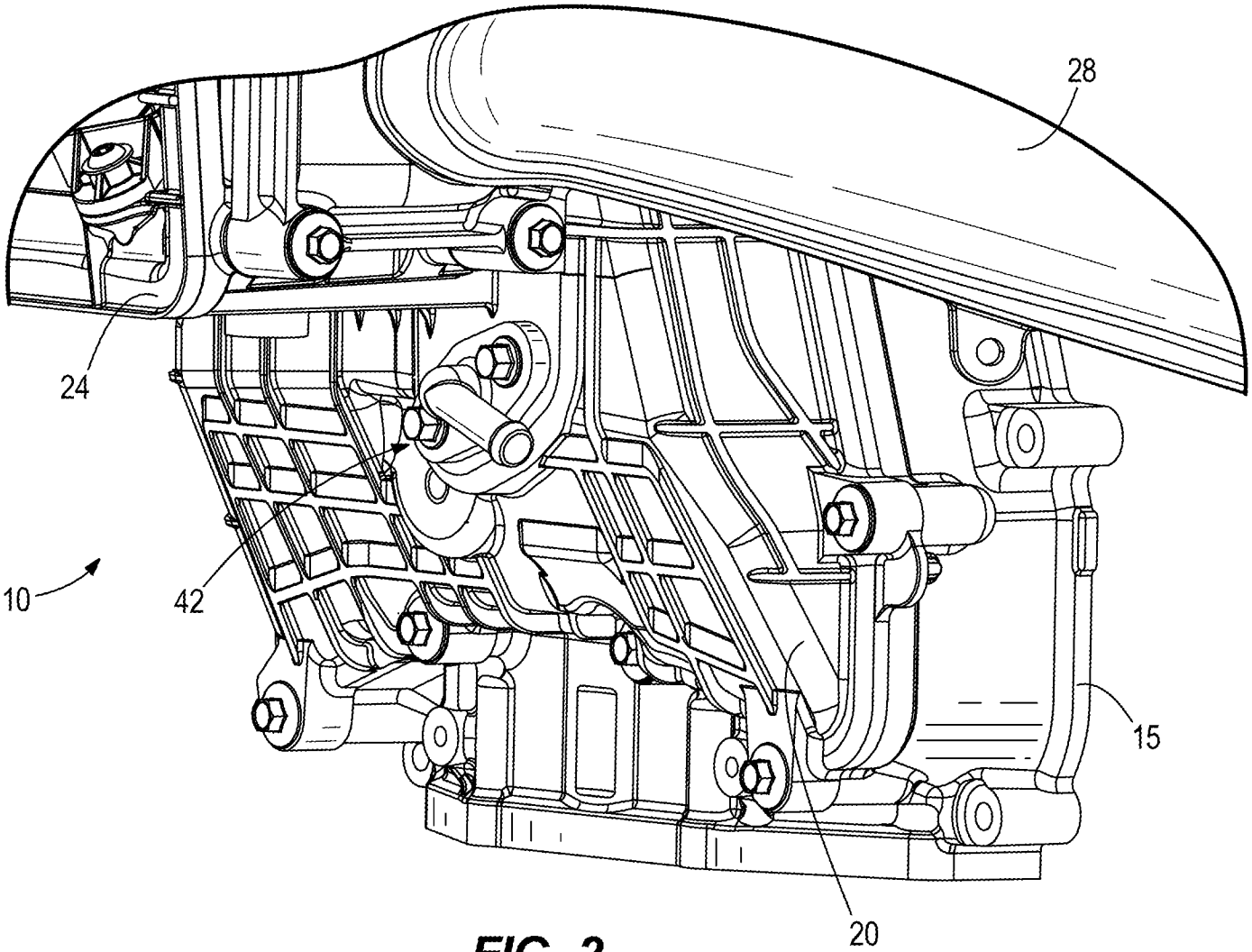
FIG. 2 is a perspective view of a lower portion of the outboard marine engine.
Figure 3:
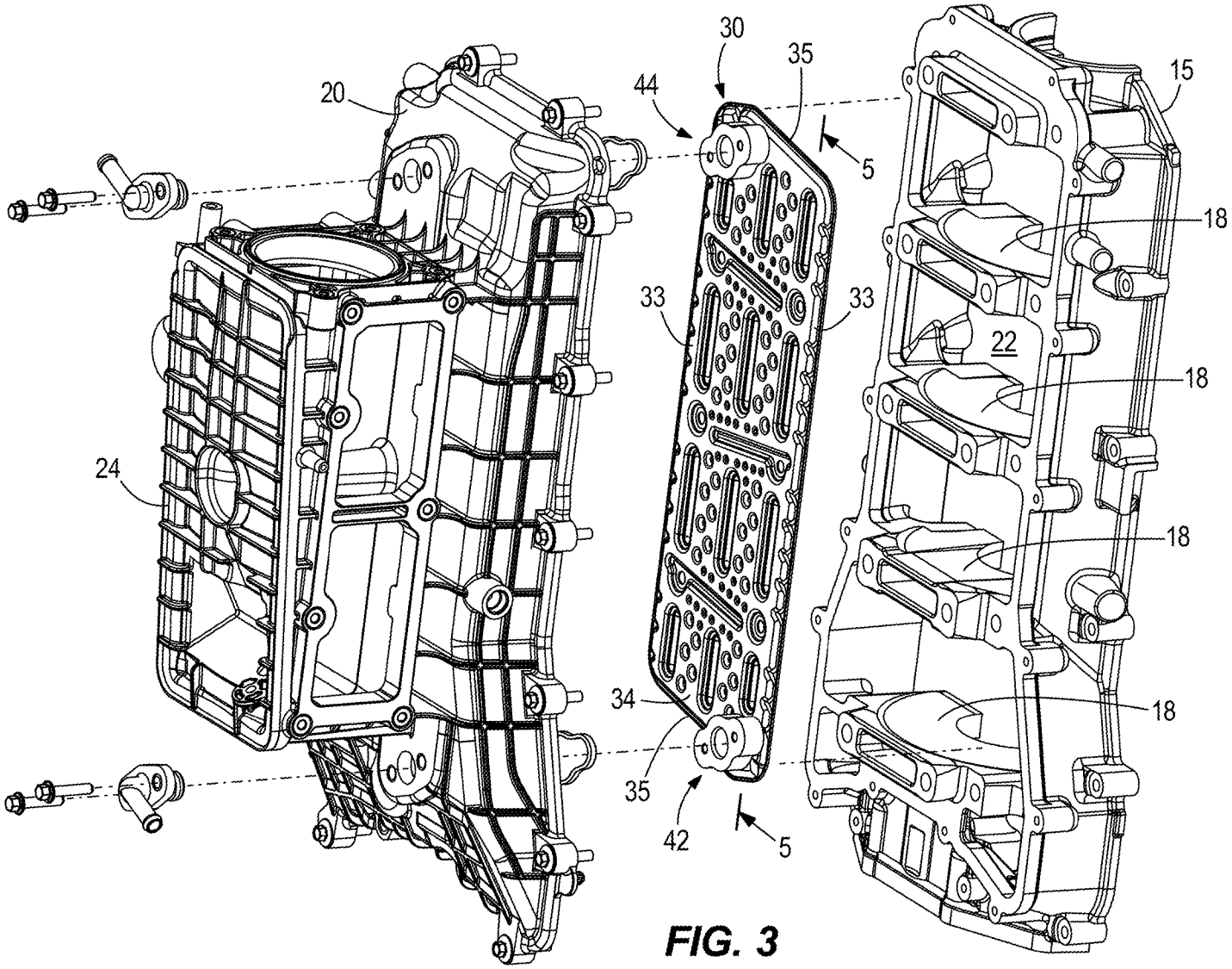
FIG. 3 is an exploded perspective view of a crankcase, crankcase cover, air inlet box, and cooling member according to the present disclosure.
Figure 4:
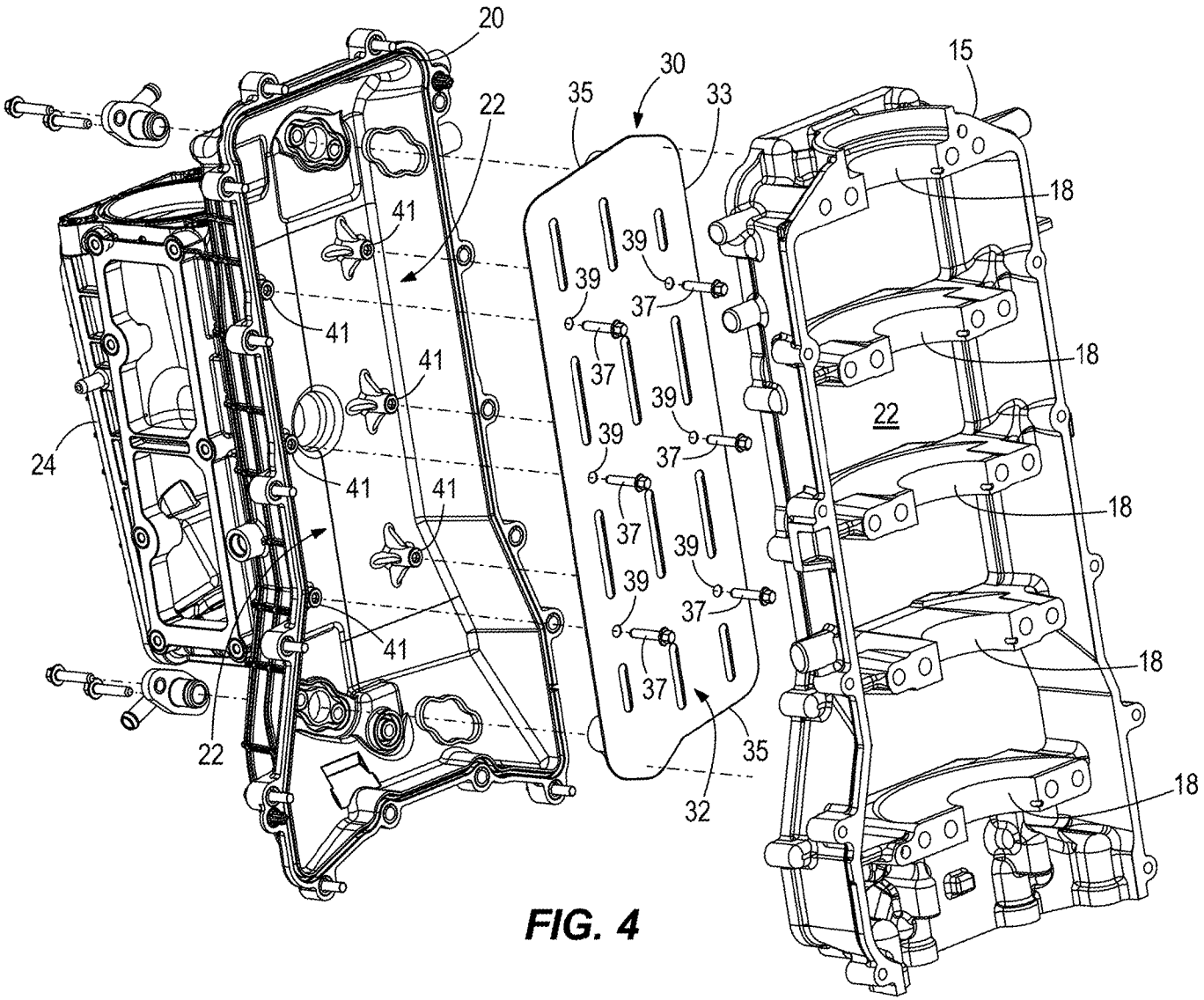
FIG. 4 is another exploded perspective view of the crankcase, crankcase cover, air inlet box and cooling member.

FIGS. 1 and 2 depict upper and lower portions of an outboard marine engine 10, respectively. As is conventional, combustion of fuel in the marine engine 10 causes rotation of a crankshaft 12 about its vertical crankshaft axis 14. The crankshaft 12 extends through and is supported within a crankcase 16. Referring to FIGS. 3 and 4, the crankcase 16, including its bedplate 15, has bearings 18 that support rotation of the crankshaft 12. A crankcase cover 20 is bolted to and closes the crankcase 16. Together, crankcase 16, including the bedplate 15, and crankcase cover 20 define an interior volume 22 that contains lubricant (e.g. oil) for lubricating and facilitating rotation of the crankshaft 12 with respect to the bearings 18.

Referring to FIG. 1, in the illustrated example, the crankcase cover 20 is integrated with an air inlet box 24. A throttle body 26 is mounted on the top of the air inlet box 24 and is configured to control inflow of air to marine engine 10 for combustion. Specifically, the air flows into the marine engine 10 via the throttle body 26, the air inlet box 24, and a plurality of air intake runners 28 that extend from the air inlet box 24 to the marine engine 10. The crankcase cover 20, air inlet box 24, throttle body 26, and air intake runners 28 are described in further detail in the incorporated U.S. patent application Ser. No. 15/295,358, and thus for brevity are not further described herein.

Figure 5:
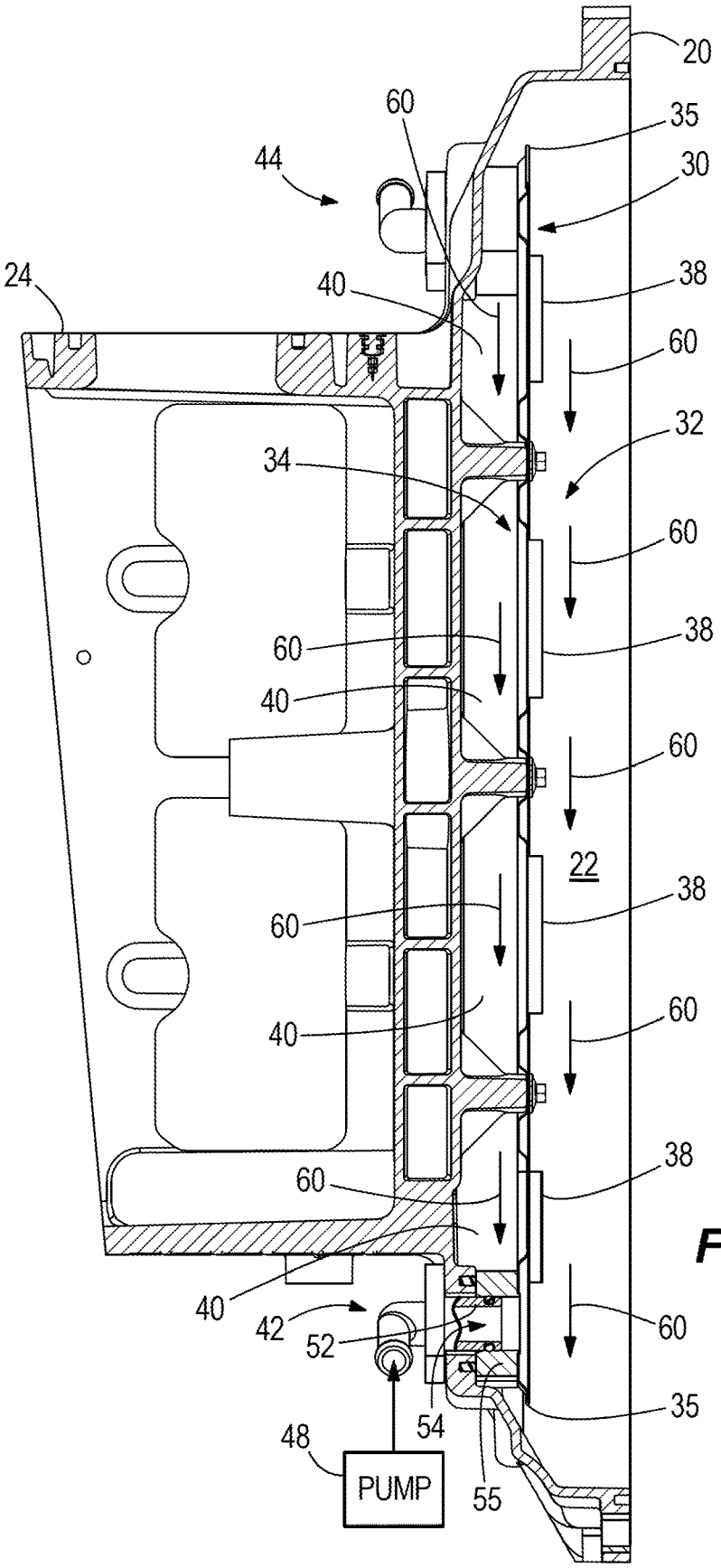
FIG. 5 is a view of vertical section 5-5, taken in FIG. 3

According to the present disclosure, a novel cooling member 30 is located within the interior volume 22. In the illustrated example, the cooling member 30 is a rectangular plate that is disposed between the bedplate 15 and the crankcase cover 20. The cooling member 30 has an inner surface 32 that faces the crankshaft 12 and an opposite, outer surface 34 that faces the crankcase cover 20. As further described herein below, the cooling member 30 is advantageously configured such that rotation of the crankshaft 12 agitates and causes the lubricant in the interior volume 22 to impinge on and then, by gravity, drain down both the inner and outer surfaces 32, 34 of the cooling member 30 (see arrows 60 in FIG. 5).

The exact configuration of the cooling member 30 can vary from that which is shown. In the example shown in FIGS. 5-9, the cooling member 30 has elongated, vertically oriented side edges 33 and horizontally oriented top and bottom edges 35 that connect the side edges 33. A plurality of windows 36 extends through the inner and outer surfaces 32, 34. The respective windows 36 are spaced apart on the cooling member 30 and are sized, shaped and located so that lubricant that is agitated and flung from the rotating crankshaft 12 impinges onto the inner surface 32 of the cooling member 30 and also travels through the plurality of windows 36 and impinges onto the outer surface 34. The shape and configuration of the plurality of windows 36 can vary from what is shown. In the illustrated example, each of the windows 36 are oval shaped and are vertically elongated and, in use, are located between the respective vertically aligned bearings 18 so that the windows 36 are open to, face, and receive lubricant that is radially flung from the rotating crankshaft 12.

Referring to FIG. 4, a plurality of fasteners 37 extends through a corresponding plurality of holes 39 in the cooling member 30 and engages with a corresponding plurality of bosses 41 on the crankcase cover 20 to thereby secure the cooling member 30 in place. The bosses 41 extend into the interior volume 22, away from the inner surface of the crankcase cover 20, so that, in use, the cooling member 30 is retained in a position that is spaced apart from the crankcase cover 20 and thereby defines a shielded cavity 40 (see FIGS. 5 and 6) between the cooling member 30 and the crankcase cover 20. The shielded cavity 40 advantageously shields the lubricant on the outer surface 34 from other agitated lubricant in the interior volume 22, and thus allows the lubricant on the outer surface 34 to efficiently drain vertically downwardly to an oil sump located below the crankcase 16, without interference from the remaining lubricant that is being agitated by the rotating crankshaft 12.

The cooling member 30 also includes a plurality of scrapers 38 located adjacent the respective plurality of windows 36 on the inner surface 32. The location, shape and orientation of the scrapers 38 can vary from what is shown. In the illustrated example, the scrapers 38 inwardly extend from the inner surface 32 towards the crankshaft 12 and are angled with respect to the inner surface 32 so as to catch the lubricant that is radially flung from the crankshaft 12 and efficiently guide the lubricant onto the cooling member 30. The plurality of scrapers 38 are vertically elongated alongside the plurality of windows 36 to guide the lubricant onto the inner surface 32 and through the plurality of windows 36 onto the outer surface 34.

The cooling member 30 includes a cooling fluid inlet 42, a cooling fluid outlet 44 and a cooling channel 46 that conveys cooling fluid (e.g., water from the body of water in which the marine vessel is operating, or any other type of cooling fluid) through the cooling member 30, from the cooling fluid inlet 42 to the cooling fluid outlet 44. A pump 48 is configured to pump the cooling fluid into the cooling fluid inlet 42, through the cooling channel 46 and out of the cooling fluid outlet 44. The pump 48 can be any type of pump that is suitable for pumping cooling fluid, for example an electric pump or a mechanical pump. The location and configuration of the respective cooling fluid inlet 42, cooling fluid outlet 44, and cooling channel 46 can vary from that which is shown. In the illustrated example, the cooling fluid inlet 42 is located vertically lower than the cooling fluid outlet 44 such that the pump 48 pumps cooling fluid through the cooling channel 46 in a vertically upward direction. The cooling channel 46 follows a circuitous path through the cooling member 30, around the plurality of windows 36 and around the plurality of holes 39. In this arrangement, when the pump 48 is turned off, for example when the marine engine 10 is not operating, the cooling fluid will advantageously drain by gravity from the cooling channel 46 via the cooling fluid inlet 42.

Optionally, the cooling member 30 can include a plurality of cooling fins or bumps or protrusions 50 (see FIG. 7) for increasing strength of the cooling member 30 and optionally for facilitating transfer of heat from the relatively hot lubricant in the interior volume 22 to the relatively cold cooling fluid in the cooling channel 46. The protrusions 50 can be formed on either or both of the inner and outer surfaces 32, 34 of the cooling member 30. The construction and location of the protrusions 50 can vary from what is shown. In use, the majority of the cooling member 30 remains unsubmerged in the lubricant in the crankcase 16.

Figure 6:
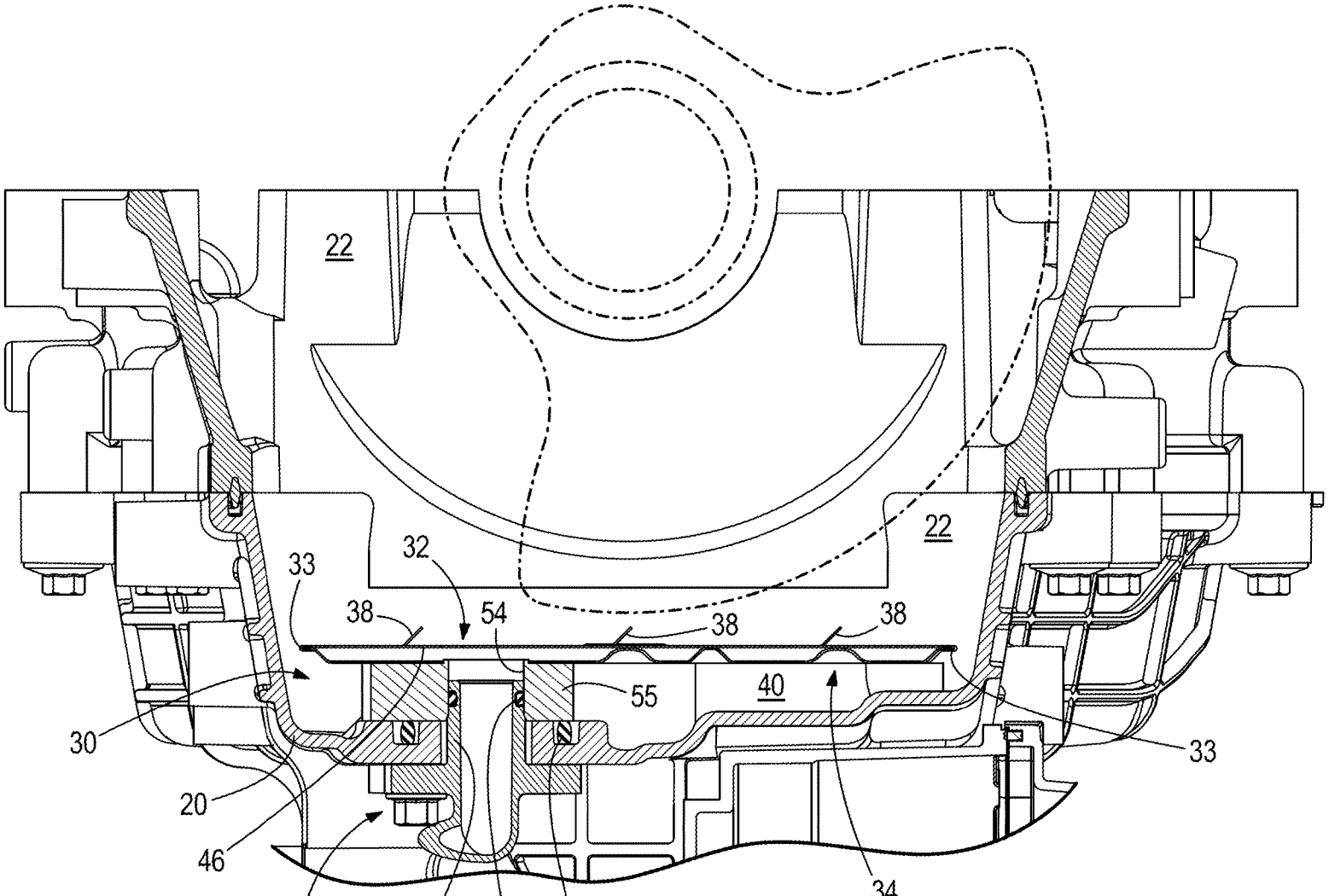
FIG. 6 is a view of horizontal section 6-6, taken in FIG. 1.
Figure 7:
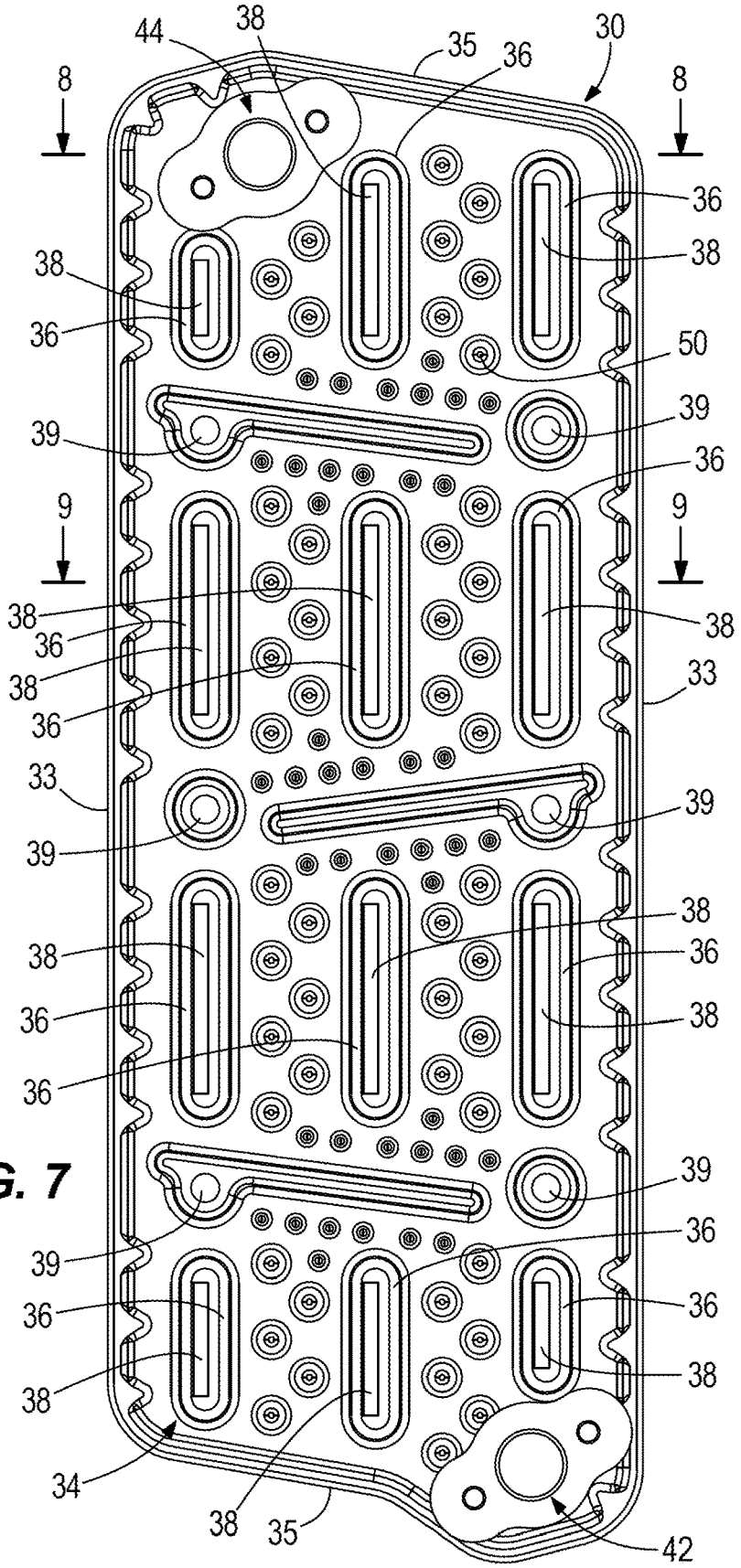
FIG. 7 is a plan view of the cooling member.
Figure 8:
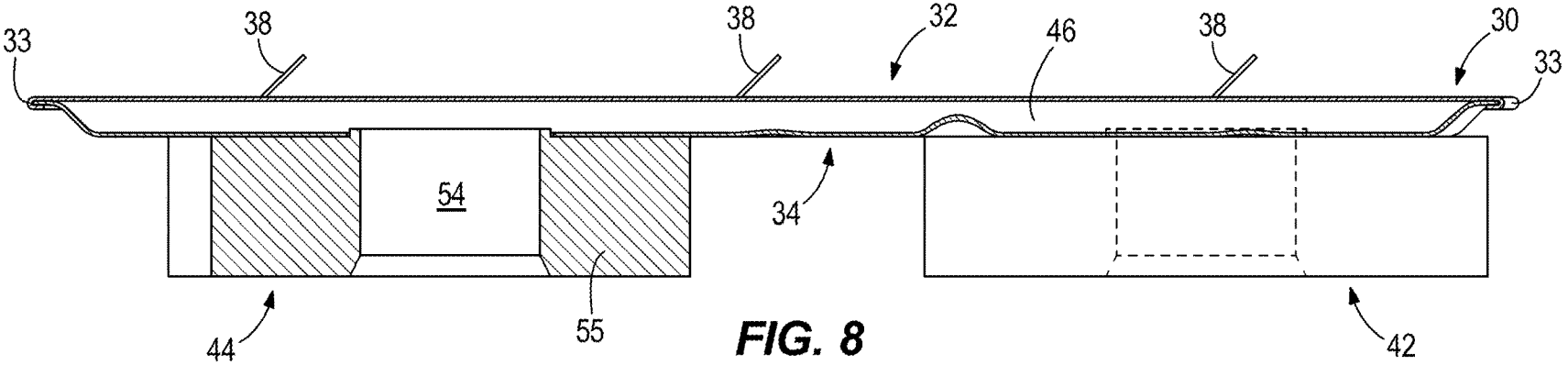
FIG. 8 is a view of horizontal section 8-8 taken in FIG. 7.
Figure 9:
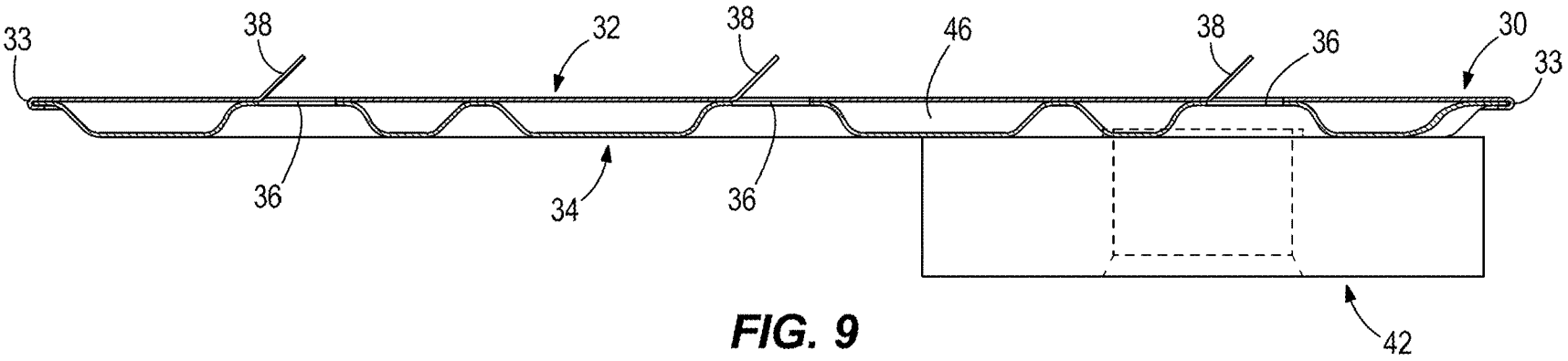
FIG. 9 is a view of horizontal section 9-9 taken in FIG. 7.

The cooling fluid inlet 42 and cooling fluid outlet 44 are sealed so as to prevent cooling fluid from mixing with the lubricant in the interior volume 22 and also to prevent the lubricant from mixing with the cooling fluid in the cooling channel 46. FIG. 6 depicts a cross-section of the cooling fluid outlet 44; however the following description equally applies to the cooling fluid inlet 42, which is constructed the same as the cooling fluid outlet 44. A boss extension 52 extends into a boss recess 54 formed on the cooling member 30. In the illustrated example, the boss recess 54 is formed in a body 55 that is formed with or fixedly adhered to the cooling member 30. An inner radial seal 56 is radially sandwiched between the boss extension 52 and boss recess 54 to thereby seal and prevent flow of cooling fluid from the cooling channel 46 into the interior volume 22. An outer axial seal 58 is disposed between the inner surface of the crankcase cover 20 and the body 55. The outer axial seal 58 seals and thereby prevents flow of the lubricant from the interior volume 22 into the cooling channel 46. Advantageously, the radial seal 56 and axial seal 58 are configured such that upon failure of the radial seal 56, the axial seal 58 will prevent cooling fluid from entering the interior volume 22. Further, upon failure of the axial seal 58, the radial seal 56 will prevent the lubricant from mixing with the cooling fluid.

Through research and development, the present inventors have determined that the above-disclosed cooling member accomplishes very efficient heat exchange between the cooling fluid and the lubricant in the crankcase. The cooling member can be made as a separate part from the crankcase (i.e., not integral with the crankcase) to therefore can be made to accommodate thermal expansion/contraction of the respective parts. The orientation and configuration of the cooling member with respect to the crankshaft advantageously promotes impingement of the lubricant onto the inner and outer surfaces, thus promoting breakdown of the lubricant and thereby accomplishing improved heat exchange. The cooling member also advantageously utilizes both inner and outer surfaces to maximize heat exchange. The cooling member was also found to lower windage losses from the cranktrain by efficiently channeling the lubricant away from the crankshaft and allowing the lubricant to return to the oil sump without being further agitated by the rotating, reciprocating components which reduces friction. For heat reduction, the cooling member was mounted internally so that the lubricant-wetted surfaces are double when compared to a surface mounted cooler. For friction reduction and enhanced cooling, the lubricant is actively shed from the reciprocating/rotating components. This is done by the above-described combination of windows and the scrapers that collects lubricant from the components and limits reintroduction of the lubricant back to the components. This is also facilitated by the above-described shielded cavity between the cooling member and the crankcase cover.

It should be mentioned that the means for mounting the cooler with respect to the crankcase can vary from that which is shown and described herein above. In alternate examples, the cooler could be mounted to the cover by other fastening mechanisms, and/or to the crankcase/bedplate by other known fastening mechanisms.

In the present description, certain terms have been used for brevity, clearness and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A marine engine comprising:

a crankcase having a crankshaft that rotates about a vertical crankshaft axis;

a cover on the crankcase;

a cooling plate disposed in an interior volume between the cover and the crankcase, the cooling plate comprising an inner surface that faces the crankshaft and an outer surface that faces the cover, wherein cooling plate is configured such that rotation of the crankshaft causes lubricant in the crankcase to impinge on and drain down both the inner and outer surfaces of the cooling plate;

wherein the cooling plate further comprises a cooling fluid inlet, a cooling fluid outlet, and a cooling channel that conveys cooling fluid from the cooling fluid inlet to the cooling fluid outlet; and a pump that pumps the cooling fluid upwardly through the cooling channel in a direction opposite to the lubricant draining down the cooling plate.

2. The marine engine according to claim 1, wherein the cooling plate comprises a plurality of windows that extend through the inner and outer surfaces, wherein rotation of the crankshaft flings the lubricant onto the cooling plate and through the plurality of windows.

3. The marine engine according to claim 1, wherein the cooling plate comprises a plurality of scrapers that extend from the inner surface towards the crankshaft, the plurality of scrapers being configured to catch the lubricant flung from the crankshaft and direct the lubricant onto the cooling plate.

4. The marine engine according to claim 3, wherein the cooling plate comprises a plurality of windows that extend through the inner and outer surfaces, wherein rotation of the crankshaft flings the lubricant onto the cooling plate and through the plurality of windows; and wherein the plurality of scrapers are adjacent to the plurality of windows.

5. The marine engine according to claim 1, wherein the cooling fluid inlet is located vertically lower than the cooling fluid outlet such that when the pump is turned off the cooling fluid drains by gravity from the cooling channel.

6. The marine engine according to claim 1, further comprising a radial seal on at least one of the cooling fluid inlet and cooling fluid outlet that prevents cooling fluid from leaking to atmosphere and an axial seal on the at least one of the cooling fluid inlet and cooling fluid outlet that prevents the lubricant from leaking to atmosphere.

7. The marine engine according to claim 6, wherein the radial seal and axial seal are configured such that upon failure of the radial seal, the axial seal prevents cooling fluid from entering the crankcase.

8. The marine engine according to claim 7, wherein the radial seal and axial seal are configured such that upon failure of the axial seal, the radial seal prevents the lubricant from mixing with the cooling fluid.

9. The marine engine according to claim 1, wherein the cooling plate forms a shielded cavity between the cooling plate and the cover, wherein the shielded cavity permits the lubricant to drain down to an oil sump without interference from rotation of the crankshaft.

10. The marine engine according to claim 1, wherein the cooling plate further comprises a plurality of cooling fins for enhanced cooling of the lubricant.

11. The marine engine according to claim 10, wherein the plurality of cooling fins is formed on both the inner and outer surfaces of the cooling plate.

12. The marine engine according to claim 1, wherein a majority of the cooling plate is unsubmerged in the lubricant in the crankcase.

13. The marine engine according to claim 1, wherein combustion in the marine engine causes the crankshaft to rotate with respect to the crankshaft axis.

14. A marine engine comprising:

a crankcase having a crankshaft that rotates about a vertical crankshaft axis;

a cover on the crankcase;

a cooling member disposed in an interior volume between the cover and the crankcase, the cooling member comprising an inner surface that faces the crankshaft and an outer surface that faces the cover, wherein cooling member is configured such that rotation of the crankshaft causes lubricant in the crankcase to impinge on and drain down both the inner and outer surfaces of the cooling member;

wherein the cooling member further comprises a cooling fluid inlet, a cooling fluid outlet, and a cooling channel that conveys cooling fluid from the cooling fluid inlet to the cooling fluid outlet; and a pump that pumps the cooling fluid upwardly through the cooling channel in a direction opposite to the lubricant draining down the cooling member.

15. The marine engine according to claim 14, wherein the cooling member comprises a plurality of windows that extend through the inner and outer surfaces, wherein rotation of the crankshaft flings the lubricant onto the cooling member and through the plurality of windows.

16. The marine engine according to claim 14, wherein the cooling member comprises a plurality of scrapers that extend from the inner surface towards the crankshaft, the plurality of scrapers being configured to catch the lubricant flung from the crankshaft and direct the lubricant onto the cooling member.

17. The marine engine according to claim 16, wherein the cooling member comprises a plurality of windows that extend through the inner and outer surfaces, wherein rotation of the crankshaft flings the lubricant onto the cooling member and through the plurality of windows; and wherein the plurality of scrapers are adjacent to the plurality of windows.

18. The marine engine according to claim 14, further comprises a plurality of cooling fins for enhanced cooling of the lubricant.

19. The marine engine according to claim 14, wherein the cooling fluid inlet is located vertically lower than the cooling fluid outlet such that when the pump is turned off the cooling fluid drains by gravity from the cooling channel.

20. The marine engine according to claim 14, further comprising a radial seal on at least one of the cooling fluid inlet and cooling fluid outlet that prevents cooling fluid from leaking to atmosphere, and an axial seal on the at least one of the cooling fluid inlet and cooling fluid outlet that prevents the lubricant from leaking to atmosphere; wherein the radial seal and axial seal are configured such that upon failure of the radial seal, the axial seal prevents cooling fluid from entering the crankcase; and wherein the radial seal and axial seal are configured such that upon failure of the axial seal, the radial seal prevents the lubricant from mixing with the cooling fluid.

* * * * *